US007387222B2

(12) United States Patent
Thompson et al.

(10) Patent No.: US 7,387,222 B2
(45) Date of Patent: Jun. 17, 2008

(54) BENDABLE CAULKING NOZZLE EXTENSION DEVICE

(76) Inventors: Roy Thompson, 178 Rosslyn Avenue South, Hamilton, Ontario (CA) L8M 3J5; Fred Thompson, 178 Rosslyn Avenue South, Hamilton, Ontario (CA) L8M 3J5

( * ) Notice: Subject to any disclaimer, the term of this patent is extended or adjusted under 35 U.S.C. 154(b) by 426 days.

(21) Appl. No.: 11/183,780

(22) Filed: Jul. 19, 2005

(65) Prior Publication Data

US 2007/0017938 A1 Jan. 25, 2007

(51) Int. Cl.
*B65D 25/48* (2006.01)

(52) U.S. Cl. ..... 222/527; 222/567; 138/118

(58) Field of Classification Search ..... 222/527, 222/383.3, 387, 529, 530, 567, 568
See application file for complete search history.

(56) References Cited

U.S. PATENT DOCUMENTS

| | | | | | |
|---|---|---|---|---|---|
| 2,277,864 | A | * | 3/1942 | Horvath | 138/110 |
| 3,402,741 | A | * | 9/1968 | Yurdin | 138/118 |
| 4,258,884 | A | | 3/1981 | Rogers | |
| 4,382,530 | A | * | 5/1983 | Calisto | 222/567 |
| 4,695,185 | A | | 9/1987 | Spells et al. | |
| 4,721,680 | A | | 1/1988 | Jeffs et al. | |
| 4,921,147 | A | | 5/1990 | Poirier | |
| 5,000,361 | A | | 3/1991 | Briddell et al. | |
| 5,004,128 | A | | 4/1991 | Richichi et al. | |
| 5,033,951 | A | | 7/1991 | Cook | |
| 5,097,994 | A | | 3/1992 | Washam | |
| 5,104,013 | A | * | 4/1992 | Hawley | 222/566 |
| 5,249,716 | A | | 10/1993 | O'Sullivan | |
| 5,307,964 | A | | 5/1994 | Toth | |
| 5,346,380 | A | | 9/1994 | Ables | |
| 5,529,226 | A | | 6/1996 | Alberth, Jr. | |
| 5,573,281 | A | * | 11/1996 | Keller | 285/40 |
| 5,775,551 | A | | 7/1998 | Tordsen | |
| 6,076,712 | A | * | 6/2000 | Esber et al. | 222/527 |
| 6,179,506 | B1 | | 1/2001 | Dewberry | |
| 6,464,115 | B2 | | 10/2002 | Wemyss et al. | |
| D468,601 | S | | 1/2003 | Horst | |
| D476,538 | S | | 7/2003 | Dorff et al. | |
| 6,769,578 | B1 | | 8/2004 | Ciofalo et al. | |
| 6,802,822 | B1 | | 10/2004 | Dodge | |
| 2003/0178446 | A1 | | 9/2003 | Osgood | |
| 2005/0133547 | A1 | * | 6/2005 | Swann | 222/566 |

* cited by examiner

*Primary Examiner*—Kevin P. Shaver
*Assistant Examiner*—Hyea J Choi
(74) *Attorney, Agent, or Firm*—Patrick J. Hofbauer

(57) ABSTRACT

A bendable caulking nozzle extension device for use with a caulking tube having a nozzle, said device comprising an elongated tube portion extending between a proximal base portion and a distal tip portion, and having a hollow passageway defined therein. The elongated tube portion is constructed from a flexible, resilient material that may be repeatedly and forcibly deformed. An attachment means is positioned within the proximal base portion for releasably affixing said device to the nozzle of the caulking tube. A deformable stiffening element is positioned on the elongated tube portion, and is constructed of a material that allows it to be repeatedly and forcibly deformed whilst substantially retaining such deformed configuration after the removal of a deforming force. Caulking material flowing from the caulking tube flows into said hollow passageway, and out of the exit aperture of the distal tip portion to a work surface remote from the nozzle of the caulking tube.

9 Claims, 1 Drawing Sheet

BENDABLE CAULKING NOZZLE EXTENSION DEVICE

FIELD OF THE INVENTION

The present invention relates to a bendable caulking nozzle extension device that is engagable with a caulking tube nozzle to facilitate the distribution of a material, such as a caulking material, to a specific location remote from the caulking tube nozzle.

BACKGROUND OF THE INVENTION

It is common in certain fields, such as in plumbing, heating and home maintenance systems, to use dispensing devices to dispense materials, such as caulking, glue, adhesive, sealant or other substances. More particularly, the use of a caulking gun to dispense material from a conventional caulking cartridge is known in the prior art. There are, however, certain limitations to the effective application of caulking materials to the location where it is needed, particularly in crowded spaces, such as around heating ducts located in rafters and the like.

Over time there has been developed various devices to facilitate the dispensing or application of caulking material to difficult-to-reach places, for example, by modifying the design of the caulking gun, such as that disclosed in U.S. Pat. No. 5,875,920. Others have redesigned the nozzle to facilitate the application of caulking material in difficult-to-reach locations, such as the caulking nozzle that is beveled on three sides, as disclosed in U.S. Pat. No. 5,775,551. Still others have provided for extensions, such as that disclosed in U.S. Pat. Nos. 4,258,884 (Rogers), or curved or flexible nozzle extensions, such as that disclosed in, U.S. Pat. No. 5,004,128 (Richici et al.), U.S. Pat. No. 5,249,716 (O'Sullivan), U.S. Pat. No. 5,346,380 (Ables) and U.S. Pat. No. 6,076,712 (Esber et al.), the teachings of which patents are all hereby incorporated herein by reference.

The bendable caulking nozzle extension device of the present invention relates to this latter group of curved or flexible nozzle extensions. The prior art of curved or flexible nozzle extensions, however, suffer from several shortcomings. For example, U.S. Pat. No. 5,249,716 discloses a caulking nozzle assembly that comprises a separate rigid curved tube that fits over a flexible caulk dispensing tube to hold the nozzle in a curved position. The caulking material within the caulk cartridge is then directionally dispensed in accordance with the curved shape imposed upon the caulk dispensing tube by the shape of the rigid curved tube. Such a flexible caulking nozzle, however, only permits for standardized directional dispensing in accordance with the shape of the rigid curved tube and thus limits the usefulness of the device. Moreover, the use of a two part assembly not only contributes to the cost of manufacture of this type of flexible caulking nozzle, but raises the possibility of losing a part of the assembly should it become detached from the other part.

Similarly, U.S. Pat. No. 6,076,712 discloses a flexible caulk tube nozzle that comprises an accordion flexible section positioned between a tapered nozzle end portion and caulk tube attachment portion to provide a mechanism for orienting the tapered nozzle end portion at a desired angle. The ability of such an accordion flexible section to bend, however, is limited by the construction of the accordion, for example, the width of the pleats of the accordion or the distances therebetween. As a result, such an accordion flexible section only permits such a flexible caulk tube nozzle to reach a limited number of difficult-to-reach places, a shortcoming also shared by the prior art devices disclosed in U.S. Pat. Nos. 5,004,128 and 5,346,380.

Additionally, known prior art flexible caulk tube nozzles such as that taught in U.S. Pat. Nos. 5,346,380 and 6,076,712 typically require the operator of a caulking gun utilizing such a flexible caulk tube nozzle to use both hands to operate the flexible caulk tube nozzle, one hand to guide and hold the tapered nozzle end portion against the work surface where the caulking material is being applied, and the other hand to hold the caulking gun and activate its dispensing trigger. The flexible caulk tube nozzle is, therefore, further limited by the ability of its operator to position his or her guide hand, particularly in tight working spaces, thereby to guide the tapered nozzle end portion.

Moreover, the use of a caulking gun to dispense material from a conventional caulking cartridge is known to generate significant back-pressure within the tube or barrel of the extension, such that it is not uncommon for known prior art nozzle extensions to 'pop' off the tapered nozzle of conventional caulking tubes or cartridges during use. This is not only frustrating for the user, but is inefficient and messy. The operator of a caulking gun may, therefore, be further concerned with ensuring that prior art nozzle extensions remain in place during the application of the caulking material to the work surface.

The present invention addresses these and other problems and shortcomings associated with the prior art by providing a caulking nozzle extension device that represents a significant improvement over known prior art caulking nozzle extension devices. More specifically, the present invention: (a) is relatively simple and inexpensive to manufacture; (b) is quickly and easily attachable to a wide variety of conventional caulking tubes or cartridges for effective dispensing of material therefrom; (c) provides attachment means that ensures that the caulking nozzle extension device will not become detached from the tapered nozzle of a conventional caulking tube or cartridge in use; (d) allows for one-handed use by an operator; (e) facilitates access to difficult-to-reach places from angles and distances determined by its operator and not by the construction or geometry of the device itself.

SUMMARY OF THE INVENTION

In accordance with one aspect of the present invention there is disclosed a bendable caulking nozzle extension device for use with a conventional caulking tube or cartridge having a nozzle, said extension device comprising a radially enlarged proximal base portion, a distal tip portion, an elongated tube portion extending between the proximal base portion and the distal tip portion and having a hollow passageway defined therein, and a deformable stiffening element positioned within said elongated tube portion. The elongated tube is constructed from a flexible, resilient material that may be repeatedly and forcibly deformed. In contrast, the deformable stiffening element is constructed from a material that allows it to be repeatedly and forcibly deformed whilst substantially retaining such deformed configuration after the removal of a deforming force. An attachment means is positioned within the proximal base portion for releasably attaching the bendable caulking nozzle extension device to the nozzle of a conventional caulking tube or cartridge, said proximal base portion also having an entrance aperture which permits caulking material to flow from such a conventional caulking tube or cartridge into the hollow passageway defined within the elongated tube portion of the bendable caulking nozzle extension device. The distal tip portion has an exit aperture which permits caulking material to flow from the hollow passageway of the elongated tube portion through said exit aperture.

In accordance with a further aspect of the present invention, the deformable stiffening element is a wire element.

In accordance with yet a further aspect of the present invention, the attachment means is formed from a base segment of the deformable stiffening element and extends into the proximal base portion of the bendable caulking nozzle extension device to facilitate operative attachment of the extension device to nozzles of conventional caulking tubes or cartridges.

In accordance with a yet further aspect of the present invention, the distal tip portion is shaped and otherwise constructed to enable caulking tips of various profiles to frictionally engage therewith in removable relation.

Other objects, advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
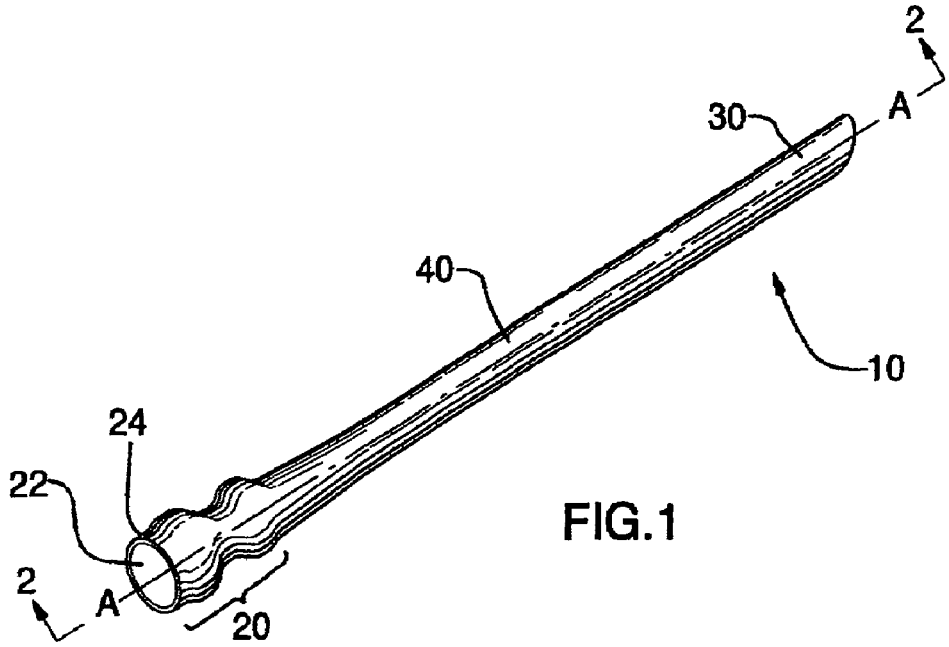
FIG. 1 is a perspective view of a preferred embodiment of a bendable caulking nozzle extension device according to the invention.
Figure 2:
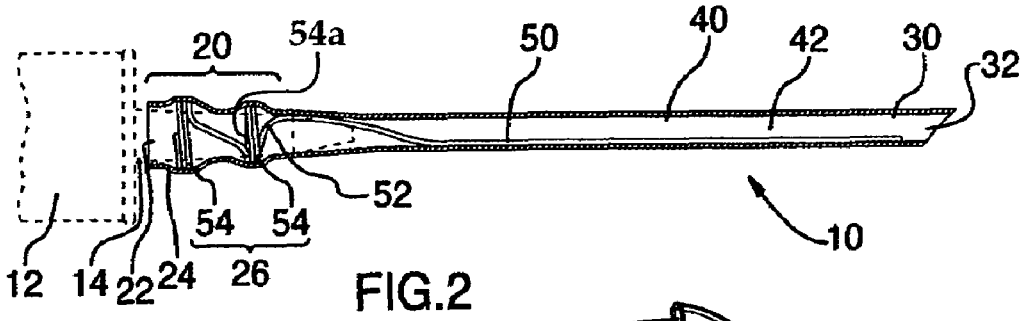
FIG. 2 is a partially sectioned side elevational view taken along sight line 2-2 of FIG. 1, showing the bendable caulking nozzle extension device attached to the nozzle of a conventional caulking tube or cartridge (with the latter shown in phantom outline)

Referring now to FIGS. 1 and 2 of the drawings, a preferred embodiment of a bendable caulking nozzle extension device 10 according to the present invention comprises a radially enlarged proximal base portion 20, a distal tip portion 30, an elongated tube portion 40 and a deformable stiffening element 50 (seen in FIG. 2), together defining a longitudinal axis A-A.

The elongated tube portion 40 extends between the proximal base portion 20 and distal tip portion 30, and has a hollow passageway 42 defined therein. It is constructed from a flexible, resilient material that allows it to be repeatedly and forcibly deformed. Suitable materials include various plastics materials, including, without limitation, low density polyethylenes, polypropylenes, polyesters and vinyls. The proximal base portion 20 and distal tip portion 30 may also be constructed of like material, and are preferably moulded, as shown, to form a unitary tubular structure. One particularly useful material for construction of both the proximal base portion 20 and the elongated tube portion 40 is vinyl tubing (such as is commonly used as air tubing with aquarium pumps), as this material has not only the desired degree of flexibility and resiliency, but is also radially distendable to accommodate the close-fitting insertion of the deformable stiffening element 50 as illustrated and described herein.

The deformable stiffening element 50 is positioned on the elongated tube portion 40. By use of the phrase "positioned on", it is meant that the deformable stiffening element 50 may be positioned on, or around, the exterior, or positioned within the interior of, the elongated tube portion 40, or otherwise associated therewith, in operative contacting relation, so as to retain the deformed shape of the elongated tube portion selected by a user. Preferably, the deformable stiffening element 50 is positioned within the elongated tube portion 40, as shown in FIG. 2.

An attachment means 26 is positioned within the proximal base portion 20 to facilitate releasably affixing the extension device 10 to the tapered nozzle 14 of a conventional caulking tube 12 (shown in phantom outline in FIG. 2). The attachment means 26 is preferably and economically formed from a base segment 52 of the deformable stiffening element 50, said base segment 52 extending from the elongated tube section 40 into the proximal base portion 20 to form one or more ring sections 54, 54 as seen in FIG. 2. Each of the one or more ring sections 54 is formed by the coiling of the base segment 52 of the deformable stiffening element 50 around the interior circumference 24 of the proximal base portion 20. In the preferred embodiment shown, each of said one or more ring sections 54, 54 is axially separated from one another, to assist in creating a partial vacuum to seal against back-pressure when the bendable caulking nozzle extension device 10 is in use. The proximal base portion 20 also has an entrance aperture 22 which permits caulking material to flow from the caulking tube 12 into hollow passageway 42.

The distal tip portion 30 has an exit aperture 32 which allows caulking material to flow from the hollow passageway 42 through said exit aperture 32 to be delivered to a work surface (not shown).

The deformable stiffening element 50 is constructed of a material that allows it to be repeatedly and forcibly deformed, whilst substantially retaining such deformed configuration after the removal of a deforming force. The positioning of the deformable stiffening element 50 on or within the elongated tube portion 40 allows the elongated tube portion 40 to retain the same deformed configuration as the deformable stiffening element 50. Preferably, and economically, the deformable stiffening element 50 is constructed from a soft, bendable metal wire, such as mild steel or iron wire, that is easily deformable by a user, yet retains its shape after such deformation.

In use, the tapered nozzle 14 of a conventional caulking tube 16 is inserted through the entrance aperture 22 of the proximal base portion 20, such that the attachment means 26 releasably affixes said extension device 10 to the nozzle 14. Specifically, the extension device 10 is attached to the nozzle 14 by the one or more ring sections 54 of the attachment means 26, which tightly grip the tapered nozzle 14 of the caulking tube 12. Sharpening the inner edges 54*a* of each of said one or more ring sections 54,54 during manufacturing will result in a tighter biting grip on the nozzle 14 of the caulking tube 12. Moreover, if the proximal base portion 20 is pushed onto the nozzle of the caulking tube 12 as tightly as possible, the likelihood of any excess caulking material flowing out from between the caulking tube 12 and said extension device 10 is little to nil, as such pushing on expels air from between the outer surface of the tapered nozzle 14, the interior circumference 24 of the proximal base portion 20, and the one or more ring sections 54,54 thereby creating the partial vacuum previously referenced.

Once securely attached in this manner, a user of the caulking tube 12 may cause caulking material to flow from the caulking tube 12 into the hollow passageway 42 of the elongated tube portion 40, and through said exit aperture 32 of the distal tip portion 30 to a work surface (not shown).

Figure 3:
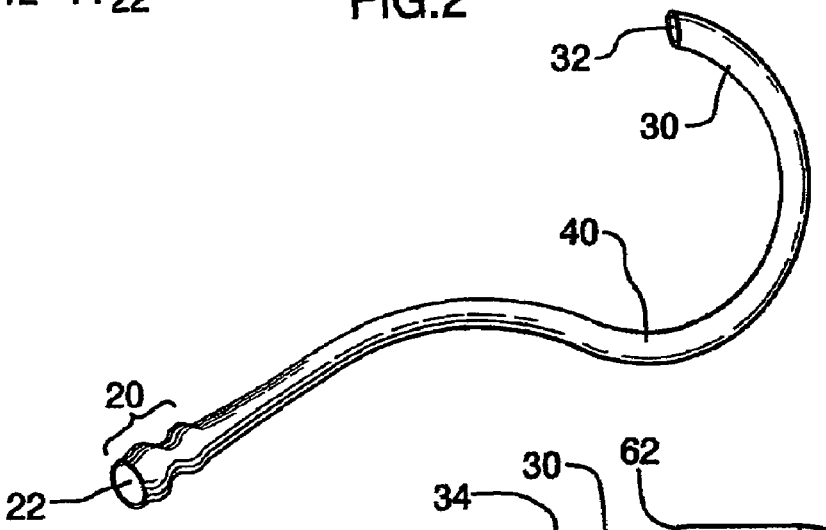
FIG. 3 is a perspective view of the bendable caulking nozzle extension device of FIGS. 1 and 2 shown in a deformed configuration.

The elongated tube portion 40 may be repeatedly and forcibly deformed, either prior to the attachment of said extension device 10 to the tapered nozzle 14, or after such attachment of said extension device 10 to the tapered nozzle 14 of the caulking tube 12. FIG. 3 shows the extension device 10 being deformably configured in one representative deformed configuration, but the extension device 10 may be deformed in a virtually infinite variety of other configurations.

Figure 4:
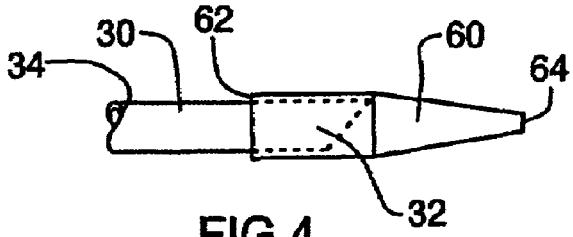
FIG. 4 is a partial side elevational view of an optional caulking tip removably installed on a distal tip portion of the bendable caulking nozzle extension device of FIGS. 1-3.

As seen in FIG. 4, the distal tip portion 30 is shaped and otherwise constructed to enable caulking tips of various profiles 60 to frictionally engage therewith in removable relation. For optimal results, it is desirable for the outer diameter 34 of the distal tip portion 30 to be slightly oversized with respect to the inner diameter 62 of said caulking tips 60 for a tight frictional fit. In use, an operator of the caulking tube 12 may, therefore, frictionally attach said caulking tips 60 to said distal tip portion 30 for caulking material to flow out of exit aperture 32 of the distal tip portion, and through exit aperture 64 of said caulking tip of various profiles 60, in beads of various sizes and cross-sections.

Other modifications and alterations may be used in the design and manufacture of other embodiments according to the present invention without departing from the spirit and scope of the invention, which is limited only by the accompanying claims. For example, the proximal base portion may be made of a separate material than that of the elongated tube portion, such as, for example, a hard plastics material, in which case it will need to be heat welded or otherwise attached in a conventional manner to the softer resilient plastics material of the elongated tube portion. Furthermore, a plurality of elongated tube portions of the present invention may be connectably engaged to form a lengthier bendable caulking nozzle extension device. Moreover, the attachment means may be a full or partial thread instead of being comprised of the one or more ring sections. Such thread portions may optionally comprise a metal thread segment or segments. These and other variations will be readily apparent to those skilled in the art without departing from the spirit and scope of the present invention.

We claim:

1. A bendable caulking nozzle extension device for use with a caulking tube having a nozzle, said extension device comprising:

a radially enlarged proximal base portion;

a distal tip portion;

an elongated tube portion extending between said proximal base portion and said distal tip portion, and having a hollow passageway defined therein;

a deformable stiffening element positioned on said elongated tube portion;

said elongated tube portion being constructed from a flexibile, resilient material that may be repeatedly and forcibly deformed;

said deformable stiffening element being constructed from a material that allows it to be repeatedly and forcibly deformed, whilst substantially retaining such deformed configuration after the removal of a deforming force;

said proximal base portion having an attachment means positioned therewithin for releasably affixing said extension device to the nozzle of said caulking tube;

said proximal base portion having an entrance aperture which permits caulking material to flow from said caulking tube into said hollow passageway;

said distal tip portion having an exit aperture which permits said caulking material to flow from said hollow passageway through said exit aperture;

said attachment means being formed from a base segment of said deformable stiffening element extending into said proximal base portion;

said base segment of said deformable stiffening element comprises two or more ring sections;

wherein each of said two or more ring sections is formed by the coiling of said deformable stiffening element around the interior circumference of said proximal base portion of said extension device, and each of said two or more ring sections are axially separated from one another.

2. The bendable caulking nozzle extension device of claim 1, wherein said deformable stiffening element is a wire element.

3. The bendable caulking nozzle extension device of claim 2, wherein each of said two or more ring sections are sharpened on their interior edges to bitingly grip the tip of a caulking tube.

4. The bendable caulking nozzle extension of claim 3, wherein said distal tip portion is shaped and constructed to enable caulking tips of various profiles to frictionally engage therewith in removable relation.

5. The bendable caulking nozzle extension device of claim 4, wherein said proximal base portion and said distal tip portion are each constructed of a plastics material that enables resilient flexibility of said proximal base portion and said distal tip portion, such that said proximal base portion and said distal tip portion may be repeatedly and forcibly resiliently deformed.

6. A bendable caulking nozzle extension device for use with a caulking tube having a nozzle, said extension device comprising:

a radially enlarged proximal base portion;

a distal tip portion;

an elongated tube portion extending between said proximal base portion and said distal tip portion, and having a hollow passageway defined therein;

a deformable stiffening element positioned on said elongated tube portion;

said elongated tube portion being constructed from a flexibile, resilient material that may be repeatedly and forcibly deformed;

said deformable stiffening element being constructed from a material that allows it to be repeatedly and forcibly deformed, whilst substantially retaining such deformed configuration after the removal of a deforming force;

said proximal base portion having an attachment means positioned therewithin for releasably affixing said extension device to the nozzle of said caulking tube;

said proximal base portion having an entrance aperture which permits caulking material to flow from said caulking tube into said hollow passageway;

said distal tip portion having an exit aperture which permits said caulking material to flow from said hollow passageway through said exit aperture;

said attachment means is formed from a base segment of said deformable stiffening element extending into said proximal base portion;

said base segment of said deformable stiffening element comprises one ring section;

wherein said ring section is formed by the coiling of said deformable stiffening element around the interior circumference of said proximal base portion of said extension device;

wherein said ring section is sharpened on its interior edge to bitingly grip the tip of a caulking tube.

7. The bendable caulking nozzle extension device of claim 6, wherein said deformable stiffening element is a wire element.

8. The bendable caulking nozzle extension of claim 7, wherein said distal tip portion is shaped and constructed to enable caulking tips of various profiles to frictionally engage therewith in removable relation.

9. The bendable caulking nozzle extension device of claim 8, wherein said proximal base portion and said distal tip portion are each constructed of a plastic material that enables resilient flexibility of said proximal base portion and said distal tip portion, such that said proximal base portion and said distal tip portion may be repeatedly and forcibly resiliently deformed.

* * * * *